US006142816A

United States Patent [19]

Kameyama

[11] Patent Number: 6,142,816

[45] Date of Patent: Nov. 7, 2000

[54] SHIELD TERMINAL AND MANUFACTURING METHOD THEREOF

[75] Inventor: Isao Kameyama, Shizuoka-ken, Japan

[73] Assignee: Yazaki Corporation, Tokyo, Japan

[21] Appl. No.: 09/490,118

[22] Filed: Jan. 24, 2000

[30] Foreign Application Priority Data

Feb. 5, 1999 [JP] Japan ..... 11-029179

[51] Int. Cl.[7] ..... H01R 4/24

[52] U.S. Cl. ..... 439/394

[58] Field of Search ..... 439/394, 585, 439/885

[56] References Cited

U.S. PATENT DOCUMENTS 5,997,335 12/1999 Kameyama et al. ..... 439/394

FOREIGN PATENT DOCUMENTS 4-21060 2/1992 Japan .
7-22107 1/1995 Japan .
11-74036 3/1999 Japan .

*Primary Examiner*—Brian Sircus
*Assistant Examiner*—Phuong Dinh
*Attorney, Agent, or Firm*—Oblon, Spivak, McClelland, Maier & Neustadt, P.C.

[57] ABSTRACT

A shield terminal is provided so as to prevent a shield wire from being damaged at time of cutting off a chain body connected to the shield terminal. The shield wire 11 includes a conductive braided wire 11*c* and an insulating outer rind 11*d*. The shield terminal 1 includes a pair of first press-fitting pieces 4, 4 and a pair of second press-fitting pieces 5, 5 all formed on an end portion of the terminal 1 and a pair of connecting edges 6, 6 and a pair of hooking pieces 7, 7 all formed on the other end portion. The second press-fitting pieces 5, 5 are provided with engagement holes 5*a*, 5*a* for engagement with the hooking pieces 7, 7. When the other end portion is folded back to the end portion of the terminal 1, the connecting edges 6, 6 are fixed on the first press-fitting pieces 4, 4 while the engagement holes 5*a*, 5*a* are engaged with the hooking pieces 7, 7. The cutting of the chain body 10 can be performed before fitting the shield wire 11 to the shield terminal 1.

6 Claims, 5 Drawing Sheets

SHIELD TERMINAL AND MANUFACTURING METHOD THEREOF

BACKGROUND OF THE INVENTION

1. Field of the Invention

The present invention relates to a ground shield terminal, another name, a coaxial terminal which is connected to a shield wire, namely a coaxial cable and also relates to a method of manufacturing the shield terminal.

2. Description of the Related Art

In connection with the shield terminal, the present applicant for this application has proposed one shield terminal of this kind and its manufacturing method. FIGS. 1 to 4 respectively show this shield terminal in an earlier art (not prior art), which is not opened to the publication.

As shown in FIGS. 1 to 3, a shield terminal 1' consists of one of plural terminal bodies 2' formed integrally so as to respectively intersect a chain body 10 in the form of a conductive band plate. While, a shield wire 11 consists of a conductive core 11*a,* an insulating inner rind 11*b* covering the core 11*a,* a braided wire 11*c* and an insulating outer rind 11*d* arranged around the braided wire 11*c* for covering it.

Each terminal body 2' is provided, on both sides of an end portion 2*a* thereof, with a pair of semi-cylindrical parts 3, 3 and a pair of press-fitting pieces 4, 4 which oppose each other. The pair of press-fitting pieces 4, 4 are to be fitted to the braided wire 11*c* of the shield wire 11 under pressure. Both sides of the other end portion 2*b* of each terminal body 2' are bent downward to provide a pair of connecting parts 6, 6 with a plurality of edges digging into the braided wire 11*c* of the shield wire 11.

Next, as shown in FIG. 1, it is carried out to fold the end portion 2*b* of each terminal body 2' in the direction A by an angle of 180 degrees and further overlap the folded end portion 2*b* on the end portion 2*a.* By this folding operation of the end portion 2*b,* the pair of connecting parts 6, 6 are disposed between the pair of press-fitting pieces 4, 4. Next, as shown in FIGS. 2 and 3, the braided wire 11*c* of each shield wire 11 is stuck into the pair of connecting parts 6, 6 for electrical connection and simultaneously, the pair of press-fitting pieces 4, 4 are crimped against each braided wire 11*c* (see FIG. 4).

After that, by cutting off the chain body 10 on both sides of each terminal body 2', the shield terminal 1' having the shield wire 11 connected thereto is completed.

In this way, because of no means for fixing the connecting parts 6, 6 to the side of the end 2*a* of each terminal body 2', the earlier art shield terminals 1' have been produced by respectively press-fitting the respective braided wires 11*c* of the shield wires 11 to the pairs of connecting parts 6, 6 and the pairs of press-fitting pieces 4, 4 previous to cutting off the chain body 10 from the respective terminal bodies 2'.

In the above-mentioned shield terminal 1' and the manufacturing method, however, there is the possibility of the shield wire 11 being damaged or cut off according to circumstances unless positioning a cutter for cutting the chain body 10 precisely. It should be noted that such a problem results from the above-mentioned manufacturing order.

SUMMARY OF THE INVENTION

Under such a circumstance, it is therefore an object of the present invention to provide a shield terminal and its manufacturing method which allow of automatic cutting of the chain body thereby to exclude the problem of damaging the shield wire at the time of cutting off the chain body and which can improve the quality of the shield terminal itself, the workability in production and also manufacturing efficiency, furthermore.

The object of the present invention described above can be accomplished by a shield terminal for connection with a shield wire consisting of a conductive core, an insulating inner rind covering the core, a conductive braided wire covering the insulating inner rind and an insulating outer rind covering the braided wire, the shield terminal comprising:

a terminal body made of conductive material, the terminal body consisting of an end portion, an intermediate portion and the other end portion, all of which are successively formed in the longitudinal direction of the terminal body;

a pair of first press-fitting pieces to be press-fitted to the braided wire of the shield wire, the pair of press-fitting pieces being integrally formed so as to stand on both sides of the end portion of the terminal body and oppose each other;

a pair of second press-fitting pieces to be press-fitted to the insulating outer rind of the shield wire, the pair of second press-fitting pieces being integrally formed so as to stand on both sides of the end portion of the terminal body and oppose each other, adjacent to the first press-fitting pieces;

a pair of connecting parts integrally formed so as to stand on both sides of the other end portion of the terminal body and oppose each other, the pair of connecting parts being configured so as to dig into the braided wire and also positioned so as to lie down on the first press-fitting pieces when the other end portion is folded back to the end portion on the boundary of the intermediate portion; and a pair of hooking parts integrally formed so as to project laterally from both sides of the other end portion of the terminal body, adjacent to the connecting parts first press-fitting pieces, the pair of hooking parts being positioned so as to lie down on the second press-fitting pieces when the other end portion is folded back to the end portion on the boundary of the intermediate portion;

wherein the second press-fitting pieces are provided with respective engagement parts which can engage with the hooking parts respectively under condition that the other end portion is folded back to the end portion on the boundary of the intermediate portion.

With the above-mentioned structure of the shield terminal, since the connecting parts can be fixed on the side of the end portion of the terminal body by the engagement of the hooking parts with the engagement parts, the cutting of the chain body can be performed before fitting the shield wire to the shield terminal. That is, owing to the change in the processing order, there is no possibility of the shield wire being damaged or cut by the automatic cutting machine erroneously. Consequently, the damage on the shield wire can be certainly avoided thereby to improve both qualities of the shield terminal and the shield wire, the workability in assembling them to each other, furthermore.

According to the second aspect of the invention, in the above shield terminal, each of the connecting parts has a leading end in the form of an edge to dig into the braided wire.

In this case, owing to the edge-shaped ends of the connecting parts, the electrical connection between the shield terminal and the shield wire can be further enhanced.

According to the third aspect of the invention, in the above shield terminal, the engagement parts are respectively constituted by engagement holes which are formed in the second press-fitting pieces, for engagement with the hooking parts.

In this case, by inserting the hooking parts into the engagement holes respectively, it is possible to fix the hooking parts to the second press-fitting pieces with ease.

According to the fourth aspect of the invention, in the above shield terminal, respective widths of both end portions of the terminal body are larger than a width of the intermediate portion.

In this case, the other end portion of the terminal body can be easily folded back to the side of the end portion because of a reduced width of the intermediate portion.

According to the fifth aspect of the invention, there is also provided a shield terminal assembly consisting of a plurality of shield terminals juxtaposed and connected with each other through a chain body, each of the shield terminals being provided for connection with a shield wire consisting of a conductive core, an insulating inner rind covering the core, a conductive braided wire covering the insulating inner rind and an insulating outer rind covering the braided wire, the shield terminal comprising:

a terminal body made of conductive material, the terminal body consisting of an end portion, an intermediate portion and the other end portion, all of which are successively formed in the longitudinal direction of the terminal body;

a pair of first press-fitting pieces to be press-fitted to the braided wire of the shield wire, the pair of press-fitting pieces being integrally formed so as to stand on both sides of the end portion of the terminal body and oppose each other;

a pair of second press-fitting pieces to be press-fitted to the insulating outer rind of the shield wire, the pair of second press-fitting pieces being integrally formed so as to stand on both sides of the end portion of the terminal body and oppose each other, adjacent to the first press-fitting pieces;

a pair of connecting parts integrally formed so as to stand on both sides of the other end portion of the terminal body and oppose each other, the pair of connecting parts being configured so as to dig into the braided wire and also positioned so as to lie down on the first press-fitting pieces when the other end portion is folded back to the end portion on the boundary of the intermediate portion; and a pair of hooking parts integrally formed so as to project laterally from both sides of the other end portion of the terminal body, adjacent to the connecting parts first press-fitting pieces, the pair of hooking parts being positioned so as to lie down on the second press-fitting pieces when the other end portion is folded back to the end portion on the boundary of the intermediate portion;

wherein the second press-fitting pieces are provided with engagement parts for engagement with the pair of hooking parts under condition that the other end portion is folded back to the end portion on the boundary of the intermediate portion.

Furthermore, according to the invention, there is provided a method of manufacturing a shield terminal to be connected with a braided wire of a shield wire, comprising the steps of:

preparing a shield terminal assembly consisting of a plurality of shield terminals juxtaposed and connected with each other through a chain body, each of the shield terminals including:

a terminal body made of conductive material, the terminal body consisting of an end portion, an intermediate portion and the other end portion, all of which are successively formed in the longitudinal direction of the terminal body;

a pair of first press-fitting pieces integrally formed so as to stand on both sides of the end portion of the terminal body and oppose each other;

a pair of second press-fitting pieces integrally formed so as to stand on both sides of the end portion of the terminal body and oppose each other, adjacent to the first press-fitting pieces;

a pair of connecting parts integrally formed so as to stand on both sides of the other end portion of the terminal body and oppose each other, the pair of connecting parts being positioned so as to lie down on the first press-fitting pieces when the other end portion is folded back to the end portion on the boundary of the intermediate portion; and a pair of hooking parts integrally formed so as to project laterally from both sides of the other end portion of the terminal body, adjacent to the connecting parts first press-fitting pieces, the pair of hooking parts being positioned so as to lie down on the second press-fitting pieces when the other end portion is folded back to the end portion on the boundary of the intermediate portion;

wherein the second press-fitting pieces are provided with engagement parts for engagement with the pair of hooking parts under condition that the other end portion is folded back to the end portion on the boundary of the intermediate portion;

folding back the other end portion to the side of the end portion thereby to arrange the connecting parts between the first press-fitting pieces;

engaging the hooking parts with the engagement parts respectively; and, previous to connecting the shield wire to the shield terminal, cutting off the chain body of the shield terminal assembly thereby to obtain at least one shield terminal.

With the above-mentioned method, since the chain body connecting the shield terminals with each other is cut off previous to the step of connecting the shield wire to the shield terminal, the productive efficiency of the shield terminals can be further improved.

These and other objects and features of the present invention will become more fully apparent from the following description and appended claims taken in conjunction with the accompany drawings.

DESCRIPTION OF THE PREFERRED EMBODIMENT

One embodiment of the present invention will be described with reference to the drawings.

Figure 1:
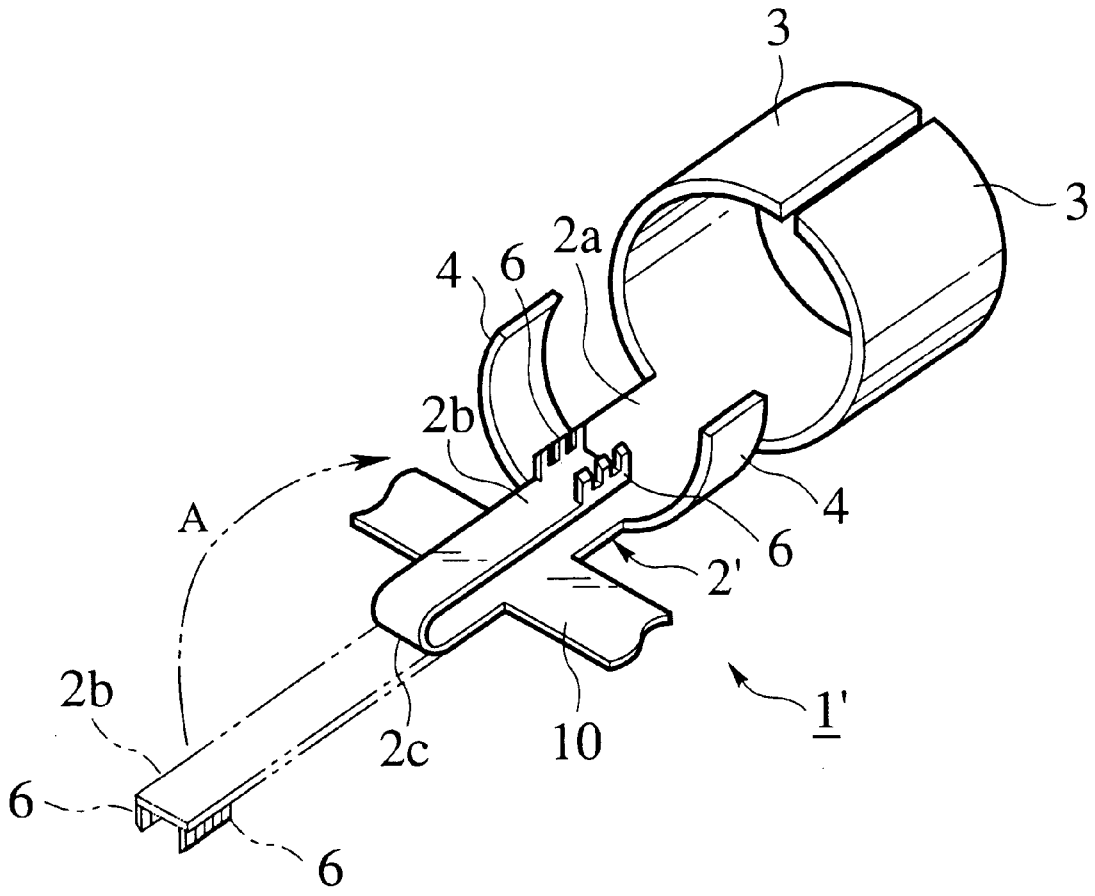
FIG. 1 is a perspective view of a shield terminal in an earlier art.
Figure 2:
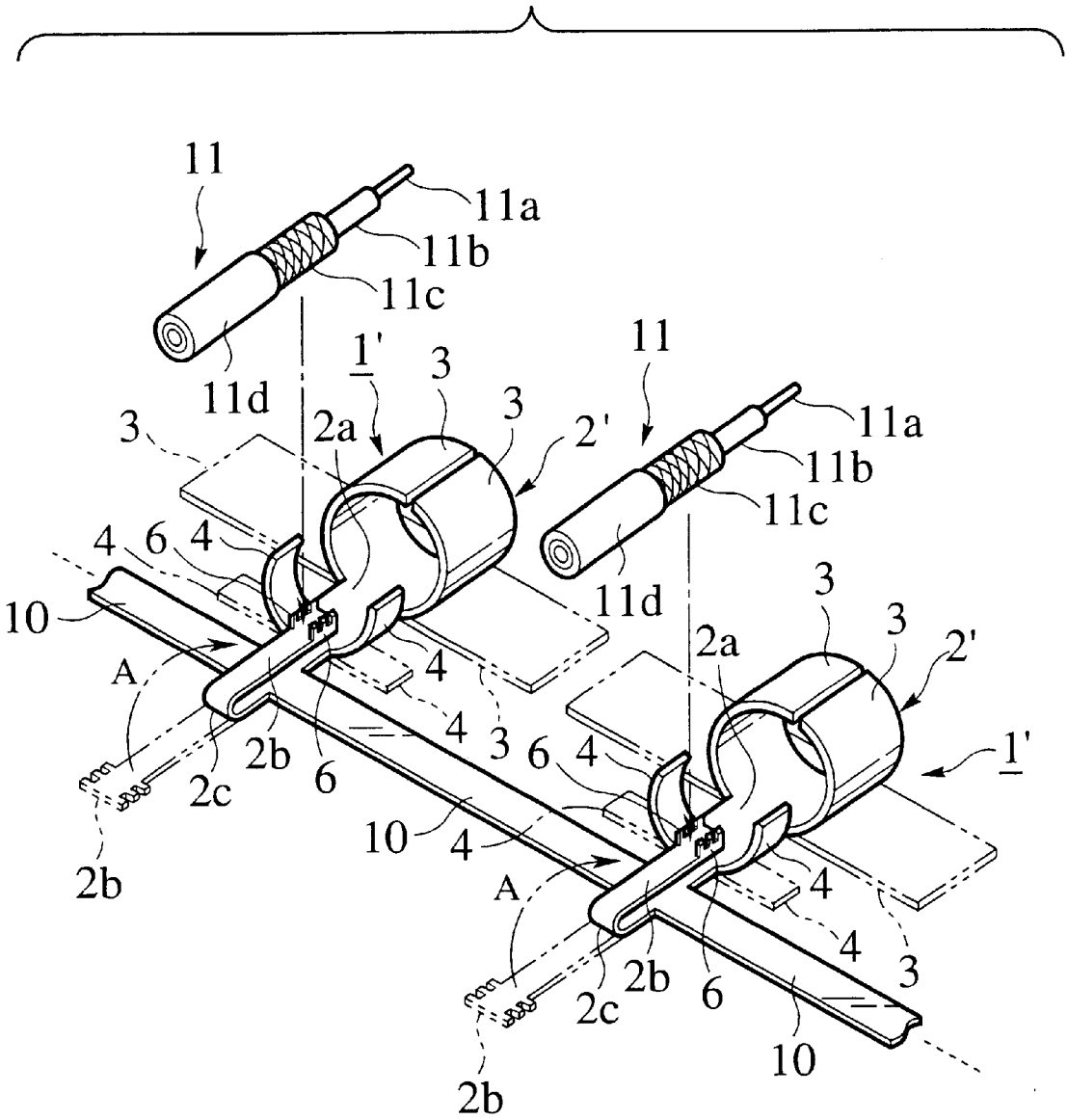
FIG. 2 is a perspective view of the shield terminal of FIG. 1, showing a condition before a shield wire is connected to a terminal body of the shield terminal.
Figure 3:
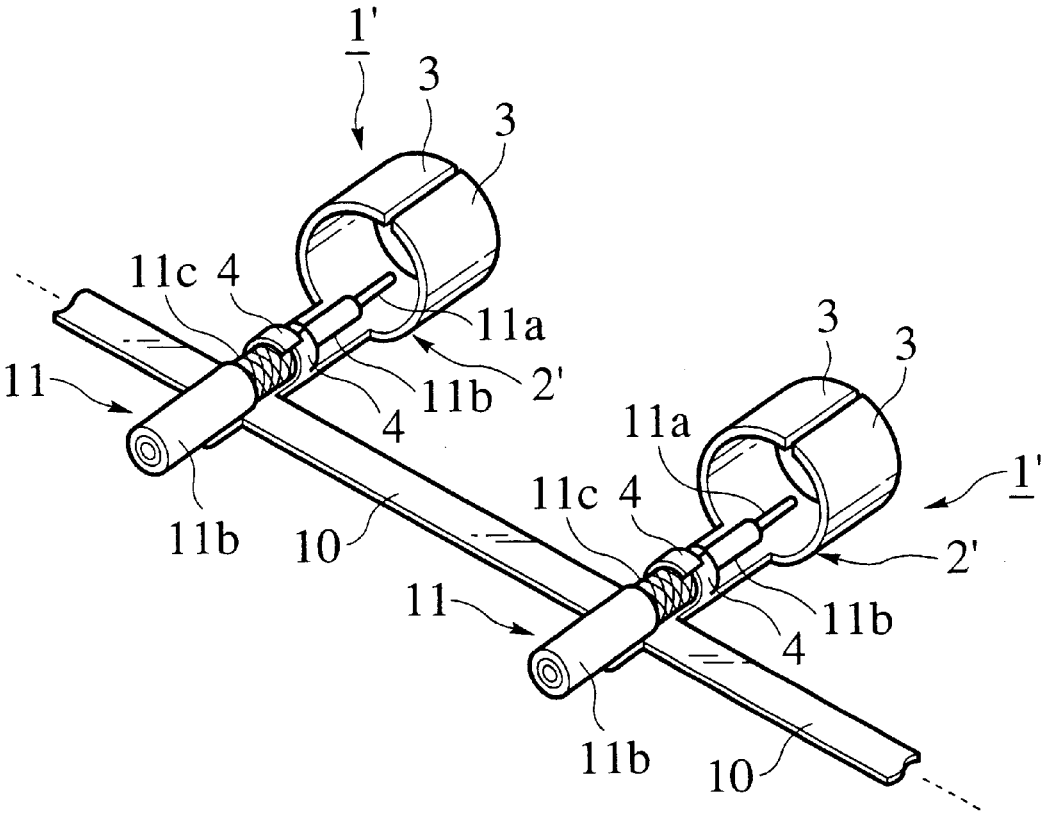
FIG. 3 is a perspective view of the shield terminal of FIG. 1, showing a condition after the shield wire is connected to the terminal body of the shield terminal.
Figure 4:
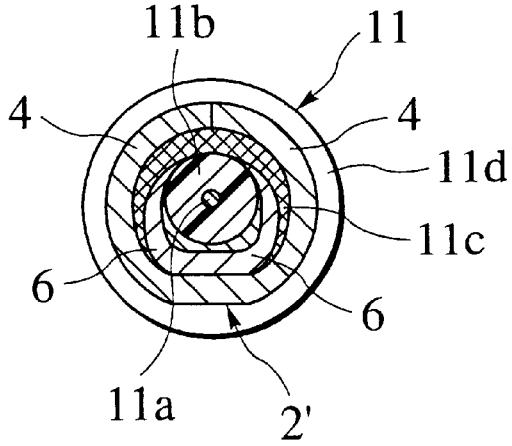
FIG. 4 is a sectional view showing a condition that the shield wire is connected to the terminal body of the shield terminal.
Figure 5:
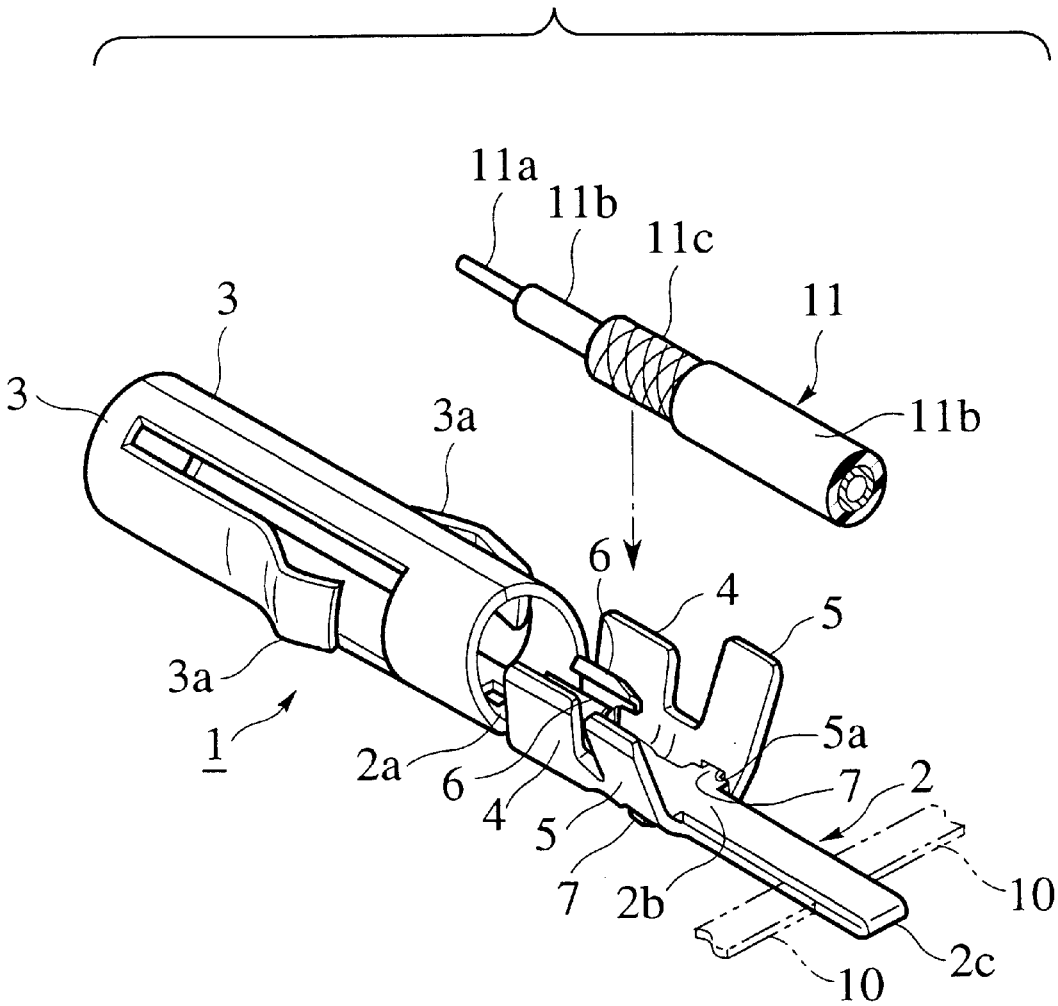
FIG. 5 is a perspective view of a shield terminal in accordance with an embodiment of the invention, also showing a shield wire to be assembled into the shield terminal.
Figure 6:
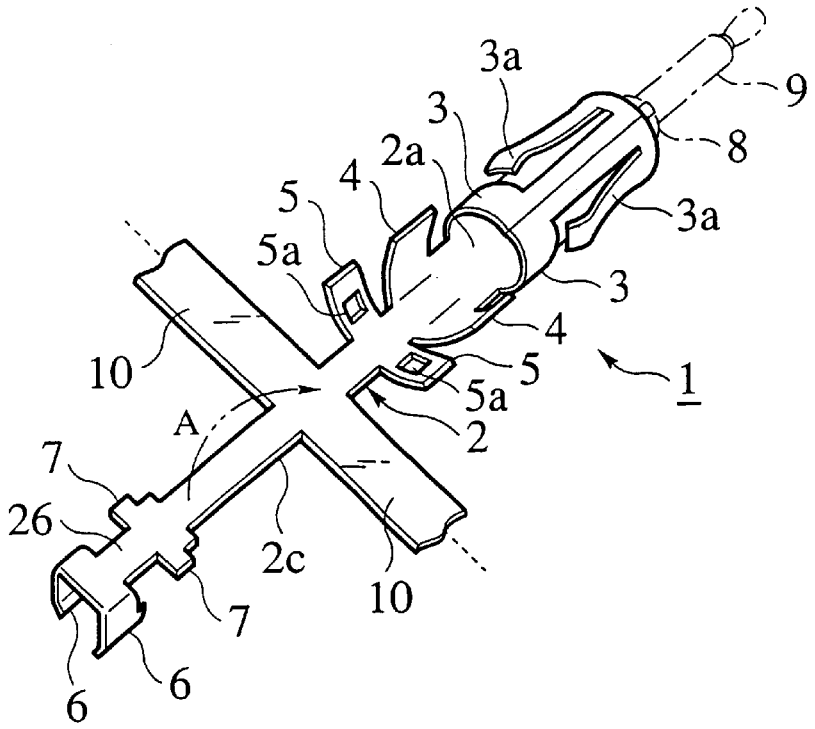
FIG. 6 is a perspective view of the shield terminal of FIG. 5 in process of manufacturing.
Figure 7:
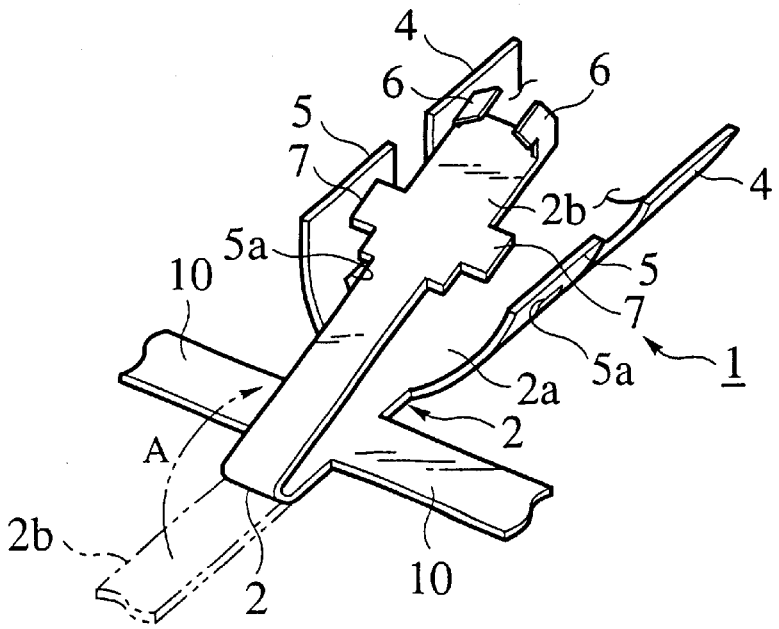
FIG. 7 is an enlarged perspective view showing an essential part of the shield terminal of FIG. 5 in process of manufacturing.

FIG. 5 is a perspective view showing a shield terminal 1 of the embodiment and the shield wire 11 to be assembled into the shield terminal 1. Further, FIG. 6 is a perspective view of the shield terminal of FIG. 5 in process of manufacturing and FIG. 7 is an enlarged perspective view showing an essential part of the shield terminal in process of manufacturing. Note, in these figures, elements similar to those of the afore-mentioned earlier art are indicated with the same reference numerals, respectively.

Similarly to the earlier art, the shield terminal 1 of the invention is constituted by one of terminal bodies 2 (only one shown in the figures) which are juxtaposed and connected with each other through the intermediary of the chain body 10 in the form of a conductive band plate.

Obviously from FIG. 6, each terminal body 2 roughly consists of the end portion 2*a,* the opposite end portion 2*b,* and an intermediate portion 2*c* interposed between the two end portions 2*a,* 2*b.* These portions 2*a,* 2*b,* 2*c* are successively formed in the longitudinal direction of the terminal body 2.

As shown in FIGS. 5 to 7, the terminal body 2 is provided, on both sides of the end portion 2*a,* with a pair of semi-cylindrical parts 3, 3 facing each other, a pair of first press-fitting pieces 4, 4 also facing each other and a pair of second press-fitting pieces 5, 5 facing each other, as well. These parts 3, 4, 5 are all obtained by bending the constituents of the terminal body 2 upward. Note, as shown in FIG. 5, the first press-fitting pieces 4, 4 of the terminal body 2 are provided for connection with the braided wire 11*c* of the shield wire 11, while the second press-fitting pieces 5, 5 are provided for connection with the insulating outer rind 11*d* of the shield wire 11.

According to the embodiment, the shield terminal 1 has a pair of rectangular engagement holes (engagement part) 5*a* each formed in the vicinity of a boundary line defining the second press-fitting piece 5. Each engagement hole 5*a* is also positioned at the substantial center of the second press-fitting piece 5 in the longitudinal direction of the terminal body 2.

On the contrary, as shown in FIG. 6, the opposite end portion 2*b* of the terminal body 2 is provided with a pair of connecting edges (connecting parts) 6, 6 which are bent downward, for digging into the braided wire 11*c* of the shield wire 11. Additionally, the end portion 2*b* of the terminal body 2 includes a pair of rectangular hooking pieces (hooking parts) 7, 7 each of which projects laterally at a predetermined distance from the adjacent connecting edge 6. Note, according to the embodiment, a width of the intermediate portion 2*c* of the terminal body 2 is smaller than either one of respective widths of the ends portions 2*a,* 2*b* in order to facilitate the folding of the end portion 2*b* to the side of the end portion 2*a*.

The semi-cylindrical parts 3, 3 have a pair of connecting elements 3*a,* 3*a* each separated and raised from the remained portion of the part 3, 3 at the substantial center. As shown with broken lines in FIG. 6, the pair of semi-cylindrical parts 3, 3 are adapted so as to accommodate a male connection-terminal 9 therein through an insulating member 8. The male connection-terminal 9 is provided, on a base end thereof, with a pair of press-fitting pieces although they are not shown in the figure. In assembling, by crimping these not-shown press-fitting pieces of the male connection-terminal 9 against the core 11*a* of the shield wire 11, the electrical connection can be effected between the shield wire 11 (i.e. the core 11*a*) and the male connection-terminal 9.

Repeatedly, the shield wire 11 consists of the conductive core 11*a,* the insulating inner rind 11*b* covering the core 11*a,* the braided wire 11*c* and the insulating outer rind 11*d* arranged around the braided wire 11*c* for covering it.

In order to manufacture the so-configured shield terminal 1, as representatively shown in FIGS. 6 and 7, it is carried out to fold the end portion 2*b* of each terminal body 2 while being connected to the chain body 10, in the direction A by an angle of 180 degrees and further overlap the so-folded end portion 2*b* on the end portion 2*a*. By this folding operation of the end portion 2*b* to the side of the end portion 2*b,* the pair of connecting edges 6, 6 are positioned between the opposing first press-fitting pieces 4, 4 for the braided wire 11*c*. At the same time of folding, the hooking pieces 7, 7 are also interposed between the somewhat-opposing second press-fitting pieces 5, 5 for the outer rind 11*d* and finally engaged in the engagement holes 5*a,* 5*a* formed in the second press-fitting pieces 5, 5, respectively.

Consequently, as shown in FIG. 5, the connecting edges 6, 6 are together secured on the side of the end portion 2*a* of the terminal body 2 since the hooking pieces 7, 7 are engaged in the engagement holes 5*a,* 5*a* of the second press-fitting pieces 5, 5. This fixation of the connecting edges 6, 6 on the first press-fitting pieces 4, 4 allows the chain body 10 connecting the juxtaposed terminal bodies 2 to be cut by an automatic cutting machine (not shown) previous to fitting the shield wire 11 to the shield terminal 1, in detail, to stick the edges 6, 6 into the braided wire 11*c* of the shield wire 11 and sequential crimp the press-fitting pieces 4, 4 onto the braided wire 11*c*.

Thus, according to the shield terminal 1, owing to its structure where the connecting edges 6, 6 can be fixed on the side of the end portion 2*a* of the terminal body 2 by the engagement of the hooking pieces 7, 7 into the engagement holes 5*a,* 5*a,* the cutting of the chain body 10 while using the automatic cutting machine can be performed before fitting the shield wire 11 to the shield terminal 1. Consequently, there is no possibility of the shield wire 11 being damaged or cut by the automatic cutting machine erroneously. Thus, the damage on the shield wire 11 can be certainly avoided thereby to improve both qualities of the shield terminal 1 and the shield wire 11, the workability in assembling them, and the manufacturing efficiency of the shield terminal 1, furthermore.

Finally, it will be understood by those skilled in the art that the foregoing description is one of preferred embodiments of the disclosed shield terminal and the manufacturing method, and that various changes and modifications may be made to the present invention without departing from the spirit and scope of the invention.

For example, the shape of the connecting edges 6 of the embodiment may be modified to other configurations, e.g. connecting parts each having a triangular tip, pin-shaped connecting parts to be stuck into the braided wire, or the like.

Additionally, the hooking pieces 7, 7 and the engagement holes 5*a*, 5*a* in the shown embodiment may be respectively modified in terms of their configurations. For example, each hooking piece (i.e. the hooking part of the invention) may be provided in the form of a projection while each engagement hole (i.e. the engagement part) is in the form of a recess for engagement with the projection.

What is claimed is:

1. A shield terminal for connection with a shield wire consisting of a conductive core, an insulating inner rind covering the core, a conductive braided wire covering the insulating inner rind and an insulating outer rind covering the braided wire, the shield terminal comprising:

a terminal body made of conductive material, the terminal body consisting of an end portion, an intermediate portion and the other end portion, all of which are successively formed in the longitudinal direction of the terminal body;

a pair of first press-fitting pieces to be press-fitted to the braided wire of the shield wire, the pair of press-fitting pieces being integrally formed so as to stand on both sides of the end portion of the terminal body and oppose each other;

a pair of second press-fitting pieces to be press-fitted to the insulating outer rind of the shield wire, the pair of second press-fitting pieces being integrally formed so as to stand on both sides of the end portion of the terminal body and oppose each other, adjacent to the first press-fitting pieces;

a pair of connecting parts integrally formed so as to stand on both sides of the other end portion of the terminal body and oppose each other, the pair of connecting parts being configured so as to dig into the braided wire and also positioned so as to lie down on the first press-fitting pieces when the other end portion is folded back to the end portion on the boundary of the intermediate portion; and a pair of hooking parts integrally formed so as to project laterally from both sides of the other end portion of the terminal body, adjacent to the connecting parts, the pair of hooking parts being positioned so as to lie down on the second press-fitting pieces when the other end portion is folded back to the end portion on the boundary of the intermediate portion;

wherein the second press-fitting pieces are provided with respective engagement parts which can engage with the hooking parts respectively under condition that the other end portion is folded back to the end portion on the boundary of the intermediate portion.

2. A shield terminal as claimed in claim 1, wherein each of the connecting parts has a leading end in the form of an edge to dig into the braided wire.

3. A shield terminal as claimed in claim 1, wherein the engagement parts are respectively constituted by engagement holes which are formed in the second press-fitting pieces, for engagement with the hooking parts.

4. A shield terminal as claimed in claim 1, wherein respective widths of both end portions of the terminal body are larger than a width of the intermediate portion.

5. A shield terminal assembly consisting of a plurality of shield terminals juxtaposed and connected with each other through a chain body, each of the shield terminals being provided for connection with a shield wire consisting of a conductive core, an insulating inner rind covering the core, a conductive braided wire covering the insulating inner rind and an insulating outer rind covering the braided wire, the shield terminal comprising:

a terminal body made of conductive material, the terminal body consisting of an end portion, an intermediate portion and the other end portion, all of which are successively formed in the longitudinal direction of the terminal body;

a pair of first press-fitting pieces to be press-fitted to the braided wire of the shield wire, the pair of press-fitting pieces being integrally formed so as to stand on both sides of the end portion of the terminal body and oppose each other;

a pair of second press-fitting pieces to be press-fitted to the insulating outer rind of the shield wire, the pair of second press-fitting pieces being integrally formed so as to stand on both sides of the end portion of the terminal body and oppose each other, adjacent to the first press-fitting pieces;

a pair of connecting parts integrally formed so as to stand on both sides of the other end portion of the terminal body and oppose each other, the pair of connecting parts being configured so as to dig into the braided wire and also positioned so as to lie down on the first press-fitting pieces when the other end portion is folded back to the end portion on the boundary of the intermediate portion; and a pair of hooking parts integrally formed so as to project laterally from both sides of the other end portion of the terminal body, adjacent to the connecting parts first press-fitting pieces, the pair of hooking parts being positioned so as to lie down on the second press-fitting pieces when the other end portion is folded back to the end portion on the boundary of the intermediate portion;

wherein the second press-fitting pieces are provided with engagement parts for engagement with the pair of hooking parts under condition that the other end portion is folded back to the end portion on the boundary of the intermediate portion.

6. A method of manufacturing a shield terminal to be connected with a braided wire of a shield wire, comprising the steps of:

preparing a shield terminal assembly consisting of a plurality of shield terminals juxtaposed and connected with each other through a chain body, each of the shield terminals including:

a terminal body made of conductive material, the terminal body consisting of an end portion, an intermediate portion and the other end portion, all of which are successively formed in the longitudinal direction of the terminal body;

a pair of first press-fitting pieces integrally formed so as to stand on both sides of the end portion of the terminal body and oppose each other;

a pair of second press-fitting pieces integrally formed so as to stand on both sides of the end portion of the terminal body and oppose each other, adjacent to the first press-fitting pieces;

a pair of connecting parts integrally formed so as to stand on both sides of the other end portion of the terminal body and oppose each other, the pair of connecting parts being positioned so as to lie down on the first press-fitting pieces when the other end portion is folded back to the end portion on the boundary of the intermediate portion; and a pair of hooking parts integrally formed so as to project laterally from both sides of the other end portion of the terminal body, adjacent to the connecting parts first press-fitting pieces, the pair of hooking parts being positioned so as to lie down on the second press-fitting pieces when the other end portion is folded back to the end portion on the boundary of the intermediate portion;

wherein the second press-fitting pieces are provided with engagement parts for engagement with the pair of hooking parts under condition that the other end portion is folded back to the end portion on the boundary of the intermediate portion;

folding back the other end portion to the side of the end portion thereby to arrange the connecting parts between the first press-fitting pieces;

engaging the hooking parts with the engagement parts respectively; and, previous to connecting the shield wire to the shield terminal, cutting off the chain body of the shield terminal assembly thereby to obtain at least one shield terminal.

* * * * *